US006491288B2

(12) United States Patent
Nagata et al.

(10) Patent No.: US 6,491,288 B2
(45) Date of Patent: Dec. 10, 2002

(54) CARBURETOR FUEL MIXTURE ADJUSTMENT ASSEMBLY

(75) Inventors: Noriyuu Nagata, Miyagi (JP); Toshihiro Hayashi, Miyagi (JP)

(73) Assignee: Walbro Japan, Inc., Tokyo (JP)

( * ) Notice: Subject to any disclaimer, the term of this patent is extended or adjusted under 35 U.S.C. 154(b) by 0 days.

(21) Appl. No.: 09/821,381

(22) Filed: Mar. 29, 2001

(65) Prior Publication Data

US 2001/0026025 A1 Oct. 4, 2001

(30) Foreign Application Priority Data

Mar. 30, 2000 (JP) ..... 2000-093638

(51) Int. Cl.[7] ..... F02M 3/08
(52) U.S. Cl. ..... 261/71; 261/DIG. 38
(58) Field of Search ..... 261/71, DIG. 38, 261/DIG. 84, DIG. 39; 137/382, 382.5

(56) References Cited

U.S. PATENT DOCUMENTS

| | | | | | |
|---|---|---|---|---|---|
| 3,469,825 | A | * | 9/1969 | DuBois | 261/71 |
| 3,484,084 | A | * | 12/1969 | Simpson et al. | 261/71 X |
| 3,618,906 | A | * | 11/1971 | Charron | 261/71 X |
| 4,568,499 | A | * | 2/1986 | Wood | 261/71 X |
| 4,853,160 | A | * | 8/1989 | Wood | 261/71 X |
| 5,667,734 | A | | 9/1997 | Ohgane | 261/71 |
| 5,707,561 | A | * | 1/1998 | Swanson | 261/71 |
| 5,753,148 | A | * | 5/1998 | King et al. | 261/71 |
| 5,948,325 | A | * | 9/1999 | Yanaka | 261/DIG. 84 |
| 5,955,007 | A | * | 9/1999 | Koizumi et al. | 261/DIG. 38 |
| 5,984,281 | A | | 11/1999 | Hacker et al. | 261/71 |
| 6,003,845 | A | | 12/1999 | Kus | 261/39.4 |

FOREIGN PATENT DOCUMENTS

| | | | | |
|---|---|---|---|---|
| JP | 54-118923 | * | 9/1979 | 261/DIG. 84 |

* cited by examiner

*Primary Examiner*—Richard L. Chiesa
(74) *Attorney, Agent, or Firm*—Reising, Ethington, Barnes, Kisselle, Learman & McCulloch, P.C.

(57) ABSTRACT

A carburetor fuel mixture adjustment assembly has a threadable holder which suppresses rotation of a needle valve body disposed within an elongated receptacle defined within a carburetor body. The threadable holder is rigidly engaged within a threading chamber of the receptacle. During assembly, the needle valve body is extended through a bore of the holder as a threading portion of the valve body rotateable cuts an interior threading groove into the threadable holder. The threadable holder is held rigidly within the threading chamber by the carburetor body. A sealing holder is disposed within the receptacle axially inward of the threadable holder and is prevented from rotating within the receptacle by the threadable holder. A stem holder portion of the sealing holder assures a needle portion of the needle valve assembly remains concentrically disposed within an outlet orifice of a fuel chamber of the receptacle. A shank holder portion of the sealing holder engages radially between a shank chamber wall of the carburetor, which axially defines a shank chamber of the receptacle, and the shank portion of the needle valve body disposed concentrically to and axially inward of the threading portion. Engagement of the shank holder portion prevents air from entering through the receptacle and into the sub-atmospheric fuel chamber, thereby assuring stable fuel flow through a fuel passage intersected by the fuel chamber and stable engine operation.

14 Claims, 3 Drawing Sheets

CARBURETOR FUEL MIXTURE ADJUSTMENT ASSEMBLY

REFERENCE TO RELATED APPLICATION

Applicants claim priority of Japanese patent application, Ser. No. 2000-093638, filed Mar. 30, 2000.

FIELD OF THE INVENTION

This invention relates to a carburetor fuel mixture adjustment assembly, and more particularly to a carburetor fuel mixture adjustment needle valve assembly for an internal combustion engine.

BACKGROUND OF THE INVENTION

It is known for a conventional fuel mixture adjustment assembly 70 as shown in FIG. 6, to include a cylindrical needle valve body 50 disposed rotateably within an elongated cylindrical needle valve receptacle 46 in a carburetor body 61 to adjust fuel flow. The fuel flows through a fuel passage 42 from a fuel metering chamber, not shown, and into a fuel-and-air mixing passage 41 via a fuel jet. The fuel passage 42 is intersected by the receptacle 46 at an inner distal end or fuel chamber 44. Rotation of the needle valve body 50 causes a stem portion 50 having a needle tip 51 of the needle valve body 50 to axially advance into, or retract out of, a fuel chamber 44 of the receptacle 46. Fuel flows traversely into chamber 44 from an inlet orifice, not shown, which communicates through the cylindrical wall of chamber 44, and flows out of an outlet passage or orifice 43 aligned concentrically to and communicating axially inward of the fuel chamber 44. The needle tip 51 projects concentrically into the outlet orifice 43 thereby obstructing fuel flow. The stem portion 52 is spaced or separated radially inward from the wall of the fuel chamber 44 thereby permitting fuel flow between the inlet and outlet orifices.

Axial advancement and retraction of the needle tip 51 within the outlet orifice 43 respectively decreases and increases the amount of fuel that can flow through the orifice 43 by decreasing and increasing the cross-sectional area of the valve restriction through at the orifice 43. An exteriorly threading portion 57 of the needle valve body 50 disposed concentrically to and axially outward from the stem portion 52 is directly threaded to a cylindrical wall 58 of the carburetor body 61 exposed within the receptacle 46. The needle valve body 50 is rotated by using a tool such as a screwdriver to engage a screw head 58 of the valve body 50 that protrudes from the carburetor body 61. In some such assemblies 70, to prevent inadvertent or uncommanded rotation of the needle valve body 50 within the needle valve receptacle 46, a tamper-resistant adjustment needle limiter cap is placed over the screw head 50 and is secured to or braced against an adjacent structure, not shown.

Fuel mixture adjustment assemblies 70 of this type include enough clearance between the respective threading portions 57 of the needle valve body 50 and the needle valve receptacle 46 to allow for lateral movement of the needle tip 51 within the outlet orifice 43 when force is applied to the head 58 of the needle valve body 50. This lateral movement can change the size of the orifice 43 enough to result in fuel flow rate changes of up to twenty percent from an optimum fuel flow rate determined by the manufacturer. Fuel flow rate changes caused by needle "slop"0 result in excessively rich or lean fuel mixtures that undesirably increase exhaust emissions. Therefore, it is desirable to reduce fuel flow fluctuations through the needle valve assembly and the resulting increase in exhaust emissions by limiting needle slop.

Suppressing unintentional rotation of the needle valve body 50 (possibly from engine vibration) which would result in inadvertent alteration of the fuel mixture is a spring 56 disposed concentrically about the needle valve body 50 and compressed axially. A conventional O-ring 54 prevents the leakage of air through the loose fitted threads within the receptacle 46 and into the sub-atmospheric pressure fuel chamber 46 thereby preventing unstable engine operation. The O-ring 54 seals against a conical annular surface 45 of the carburetor body 61 and a shank portion 53 engaged concentrically between the stem portion 52 and the threading portion 57 of the needle valve body 50. Since the diameter of the shank portion 53 is less than the diameter of the threading portion 57 the shank portion 53 has an axial inward facing annular surface. The spring 56 is compressed axially between the O-ring 54 and the shank portion 53 or annular surface. The axial forces produced by the compressed spring 56 suppress rotation of the needle valve body 50 and assures that the O-ring 54 remains seated sealably between the carburetor body 61 and the shank portion 53 of the needle valve body 50. Unfortunately, the O-ring and spring are two additional parts which are costly to manufacture and assemble in the carburetor.

SUMMARY OF THE INVENTION

A carburetor fuel mixture adjustment assembly has a threadable holder which suppresses uncommanded rotation of a needle valve body disposed threadably through the threadable holder within an elongated receptacle extending into a carburetor body. A needle portion of the needle valve body advances and retracts into and out of a fuel passage, which feeds fuel to a fuel-and-air mixing passage within the carburetor, via rotation of the needle valve body to respectively decrease and increase fuel flow through the fuel passage. Preferably, a sealing holder disposed within the receptacle has a stem holder portion and a shank holder portion. The stem holder portion holds a stem portion and thereby assures that a needle portion of the needle valve body remains concentrically disposed within an outlet orifice of a fuel chamber of the receptacle which intersects the fuel passage. The shank holder portion disposed within a sealing chamber of the receptacle provides a seal radially between the needle valve body and a sealing chamber wall of the carburetor body preventing air ingress to the sub-atmospheric fuel chamber.

The threadable holder is prevented from rotating within the receptacle via engagement of a clockwise rotational stop surface and a counterclockwise rotational stop surface of the carburetor body with respective clockwise facing surface and counterclockwise facing surface of the threadable holder. The threadable holder prevents rotation of the sealing holder within the receptacle by engagement of a first rotational stop of the shank holder portion with the clockwise facing surface of the threadable holder and engagment of a second rotational stop of the shank holder portion with the counterclockwise facing surface of the threadable holder. The threadable holder is made of a softer material than the needle valve body so that the threading portion of the needle valve body is capable of tapping or forming thread grooves into the rigidly held threadable holder as the needle valve body is screwed into the receptacle.

Preferably, the threadable holder is tightly fitted within a threading chamber of the receptacle. The bottom of the threading chamber is defined by an axial inner shelf and an axial outer shelf which both face outward with respect to the carburetor body. The ends of the inner and outer shelves are interconnected about a centerline of the receptacle by the clockwise and counter clockwise rotational stop surfaces of the carburetor body. Extended axially inward from the inner perimeter of the resultant annular shelf of the threading chamber is a sealing chamber wherein the shank holder portion of the sealing holder is tightly fitted. Inward of the sealing chamber is a fuel chamber. The shank portion of the needle valve body disposed between the needle portion and the threading portion is axially aligned to the sealing chamber and the needle portion is substantially axially aligned to the fuel chamber.

Objects, features and advantages of this invention include the prevention of air ingress into the fuel passage through the receptacle when the fuel chamber is self atmospheric and the prevention of fuel leakage through the receptacle when the fuel chamber is at atmospheric pressure. Furthermore, the needle portion is stabilized or centered concentrically within the fuel chamber. Yet another advantage, is the sealable thread feature between the threadable holder and the threading portion of the needle valve body preventing looseness of the body and uncommanded rotation of the needle valve body which can alter fuel mixture increasing exhaust emissions. The cost of manufacturing is reduced by the elimination of the O-ring and spring utilized for a conventional carburetor fuel mixture adjustment assembly.

BRIEF DESCRIPTION OF THE DRAWINGS

These and other objects, feature and advantages of this invention will be apparent from the following detailed description of the preferred embodiments and best mode, appended claims and accompanied drawings in which:

DETAILED DESCRIPTION OF THE PREFERRED EMBODIMENTS

Figure 1:
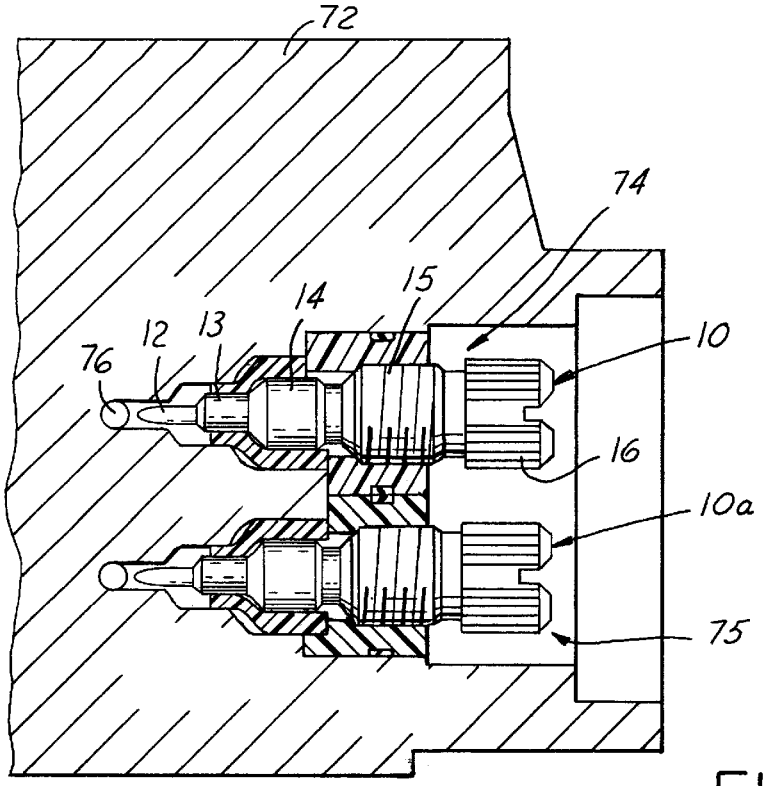
FIG. 1 is a cross sectional view of a carburetor fuel mixture adjustment assembly according to the present invention.
Figure 2:
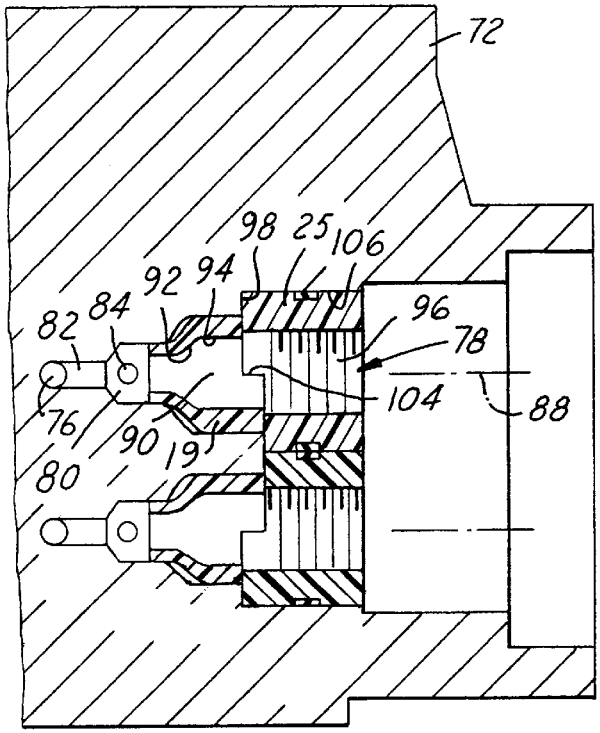
FIG. 2 is a cross section view of the carburetor fuel mixture adjustment assembly with a high and a low speed needle valve body removed to show detail.
Figure 3:
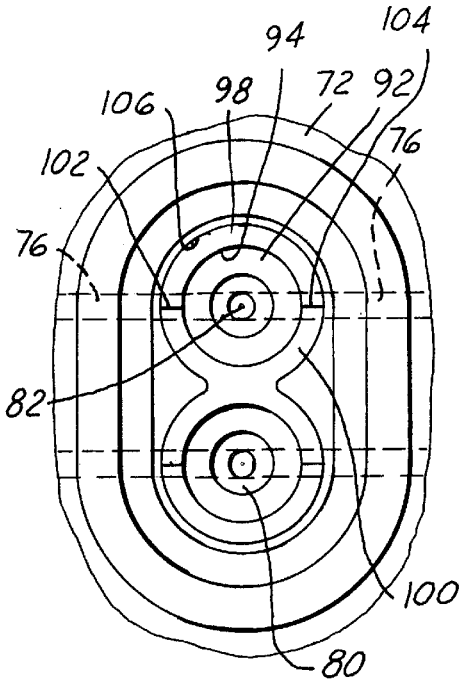
FIG. 3 is a partial planar side view of a carburetor body illustrating a low and a high speed receptacle.

As shown in FIGS. 1–3, integrated into a carburetor body 72 is a fuel mixture adjustment assembly 74 of the present invention. Typically, two such assemblies 74 are positioned within the single carburetor body 72, one for low speed engine operation and one for high speed engine operation. As shown in FIG. 1, a low speed needle valve body 10 is threadably disposed within a receptacle 78 which intersects a fuel passage 76 defined by the carburetor body 72. Rotation of the needle valve body 10 causes the body to advance or retract within the receptacle 10 thereby obstructing the fuel passage 76 by varying amounts to control fuel flow. A high speed needle valve body 10*a* operates, likewise, within its own receptacle 78. Body 10*a* is disposed substantially parallel and next to the low speed needle valve body 10 and obstructs an independent fuel passage to control high speed fuel flow. For description simplicity, and since both needle valve bodies are similar, further discussions will be limited to the low speed needle valve body 10.

Figure 5:
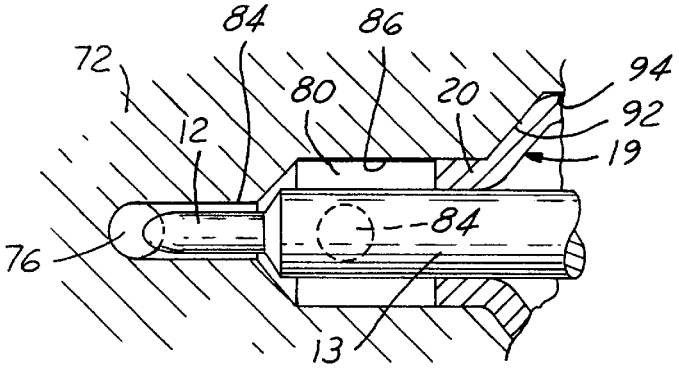
FIG. 5 is an enlarged cross section view of the carburetor fuel mixture adjustment assembly illustrating a needle portion and a shank portion of the needle valve body disposed within a respective outlet orifice and a fuel chamber of the carburetor body.
Figure 6:
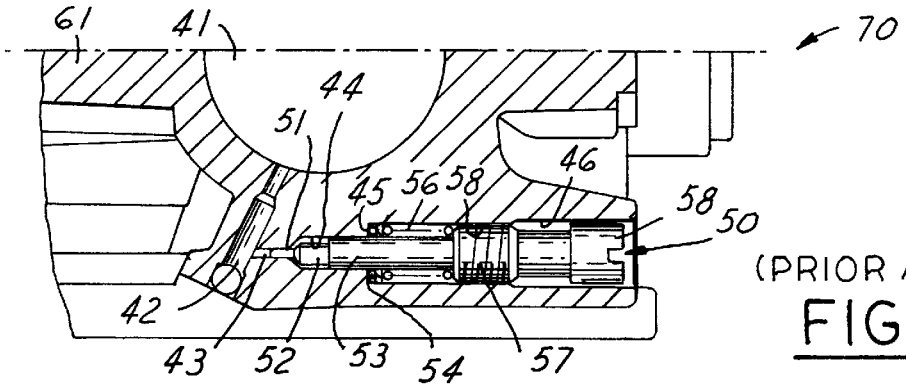
(PRIOR ART) FIG.6
FIG. 6 is a cross section view of a conventional carburetor fuel mixture adjustment assembly.

Each elongated receptacle 78 extends axially outward with respect to the carburetor body 72 from the fuel passage 76 along a centerline 88. Intersecting the fuel passage 76 is a cylinder valve chamber or fuel chamber 80 of the receptacle 78. A needle portion 12 of the needle valve body 10 has a slightly conical shape and concentrically extends into an outlet orifice 82 communicating with the fuel chamber 80 about the centerline 88. The needle portion 12 projects concentrically inward from a stem portion 13 of the needle valve body 10 which is axially disposed within the fuel chamber 80 of the carburetor body 72. As shown in FIG. 5, the fuel chamber 80 is defined radially by a substantially cylindrical wall 86 having a diameter greater than the needle and stem portions 12, 13 of the needle valve body 10. Penetrating the wall 86 is a fuel inlet orifice 84. Fuel flows into the fuel chamber 80 and out of the chamber 80 by way of the outlet orifice 82 which is adjustably obstructed concentrically by the advancing and retracing needle portion 12.

A sealing chamber 90 of the receptacle 78 communicates with and is aligned axially outward from the fuel chamber 80 with respect to the carburetor body 72. The sealing chamber 90 is defined by an annular and substantially conical shelf 92 which extends radially outward from the axially-outer end perimeter of the fuel chamber wall 86 to a substantially cylindrical sealing chamber wall 94. Communicating concentrically with, and disposed axially outward from, the sealing chamber 90 is a threading chamber 96 of the receptacle 78. Because the diameter of the sealing chamber 90 is less than the diameter of the threading chamber 96, the axially outward end or perimeter of the sealing chamber wall 94 is congruent to the inner perimeter or edge of an axially-inward semi annular shelf 98 and an axially-outer semi annular shelf 100. Shelves 98, 100, together form a "stepped" annular surface which extends radially outward from the sealing chamber wall 94. Both semi annular shelves 98 and 100 lie within respective imaginary planes disposed perpendicular to the centerline 88. Interconnecting the ends of the semi annular shelves 98 and 100 are respective clockwise and counter clockwise rotational stop surfaces 102 and 104 in the carburetor body 72. Stop surfaces 102 and 104 extend radially inward from a threading chamber wall 106 to the sealing chamber wall 94. The threading chamber wall 106 of the carburetor body 72 radially defines the threading chamber 96 and extends axially outward from the semi annular shelves 98 and 100.

Figure 4:
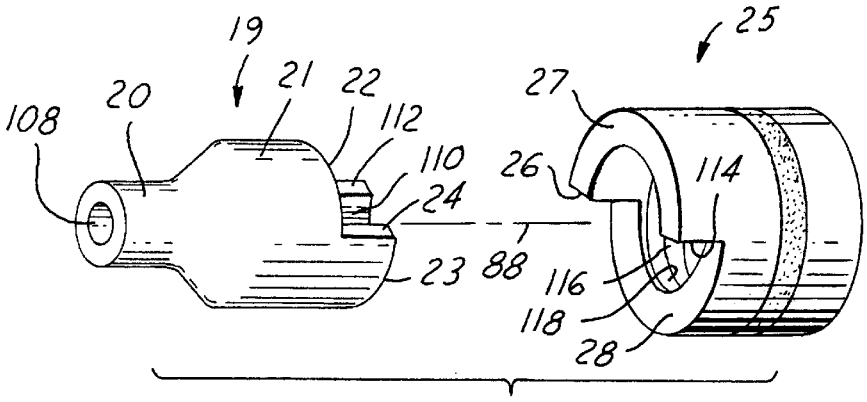
FIG. 4 is a perspective exploded view of a sealing holder and a threadable holder of the carburetor fuel mixture adjustment assembly.

Referring to FIGS. 1 and 4, press fitted sealably into the sealing chamber 90 and projecting partially into the fuel chamber 80, but stopping axially short of the inlet orifice 84, is a stepped sealing holder 19. The sealing holder 19 has a stem holder portion 20 which sealably and radially engages between the fuel chamber wall 86 and the cylindrical surface of the stem portion 13 of the needle valve body 10. The stem holder portion 20 assures that the needle portion 12 remains concentrically disposed within the outlet orifice 82 regardless of lateral forces exerted upon the outer distal end or head portion 16 of the needle valve body 10, or, rotation of the body 10.

Sealably conforming to the annular conical surface 92 and the sealing chamber wall 94 is a shank holder portion 21 of the sealing holder 19. The stem holder portion 20 defines a small diameter bore 108 disposed concentrically about the centerline 88 and communicates axially outward with a larger diameter bore 110 extended through and defined by the shank holder portion 21 of the sealing holder 19. The stem holder portion 20 of the sealing holder 19 conforms and seals slideably about the stem portion 13 of the needle valve body 10. Likewise, a shank portion 14 of the needle valve body 10 is concentrically disposed between the stem portion 13 and a threading portion 15 of the needle valve body 10, and slidably and sealably engages to the shank holder portion 21 of the sealing holder 19.

The shank holder portion 21 has a semi-annular recessed outward end surface 22 and a semi-annular distal outer end surface 23. End surfaces 22 and 23 each lie within their own imaginary planes, both planes substantially traverse the centerline 88. The ends of the end surfaces 22, 23 are interconnected by a first and second rotational stops 24, 112. Preferably, stop 24, stop 112 and centerline 88 substantially lie within the same imaginary plane. Likewise, the clockwise and counter clockwise rotational stop surfaces 102 and 104 of the carburetor body 72 substantially lie within the same imaginary plane and in assembly are disposed radially outward from respective stops 24, 112 of the sealing holder 19.

Rotation of the sealing holder 19 within the receptacle 78 is prevented by a threadable holder 25 which sealably engages the threading chamber wall 106. The threadable holder 25 has a distal inner end surface 27 which axially engages both the recessed outer end surface 22 of the sealing holder 19 and the semi annular shelf 98 of the carburetor body 72. Likewise, the threadable holder 25 has a semi annular recessed inner end surface 28 which engages the distal outer end surface 23 of the sealing holder 19 and the semi annular shelf 100 of the carburetor body 72.

During assembly, the sealing holder 19 is press fitted axially into the receptacle 78 by the threadable holder 25. When the end surfaces 27, 28 of the threadable holder 25 engage the semi annular shelf surface 98, 100, which define the end or bottom of the threading chamber 96, the sealing holder 19 is properly positioned and axially aligned within the receptacle 78. The conical shelf 92 prevents the sealing holder 19 from further moving axially inward into the fuel chamber 80 thereby preventing the stem holder portion 20 of the sealing in holder 19 from inadvertently blocking the inlet orifice 84 of the fuel chamber 80.

The ends of the distal inner end surface 27 and the recessed inner end surface 28 are interconnected by the axially extending counter clockwise facing surface 26 and the clockwise facing surface 114. The sealing holder 19 is prevented from rotating within the receptacle 78 by the threadable holder 25 and the threadable holder 25 is prevented from rotating within the receptacle 78 by the obstructing carburetor body 72. In other words, the counter clockwise facing surface 26 of the threadable holder 25 engages both the counter clockwise rotational stop surface 104 of the carburetor body 72 and the first rotational stop 112 of the sealing holder 19. The clockwise facing surface 114 of the threadable holder 25 engages both the clockwise rotational stop surface 102 of the carburetor body 72 and the second rotational stop 24 of the sealing holder 19.

Holding the threadable holder 25 stationary within the receptacle 78 is particularly important since a threading portion of the needle valve body 10 disposed axially between the shank portion 14 and the head portion 16, threadably engages the threadable holder 25 by cutting threaded grooves 118 into the inner surface of the threadable holder 25 which defines the bore 116. The needle valve body 10 is therefore preferably made of a material harder than that of the threadable holder 25. Preferably, the needle body is metallic such as steel, and the threadable holder 25 is a polymer resin. This thread tapping process forms a tight tolerance between the needle valve body 10 and the carburetor body 72 eliminating any wobble or looseness of the needle valve body 10 which could cause air leakage through the fuel chamber 80 and/or inadvertent changes in the cross sectional area of the outlet orifice 82 which could create fuel flow instabilities, rough combustion engine operation, affect fuel to air ratio of mixture, and engine performance and emissions.

Once properly threaded, the threading portion 15 of the needle valve body 10 aligns axially with the bore 116 of the threadable holder 25; the shank portion 14 aligns axially with the shank holder portion 21 of the sealing holder 19; and the stem or stem portion 13 of the needle valve body 10 aligns axially and sealably with the stem holder portion 20 of the sealing holder 19. As described above, the fuel regulating needle valve bodies 10 and 10*a* are not directly engaged to the carburetor body 72, and the stem portion 13 and the shank portion 14 are supported on the respective small diameter stem holder portion 20 and the larger diameter shank holder portion 21 of the stepped sealing holder 19. Therefore, the air tightness within the receptacles 78 of the fuel regulating needle valve bodies 10, 10*a* is maintained, the transfer of vibrations of the engine to the fuel regulating needle valve bodies 10, 10*a* via the carburetor body 72 is suppressed, and in particular, the uncommanded rotation of the needle portion 12 as a result of engine vibration is suppressed and stability and concentricity thereof is maintained thereby assuring stable fuel flow and a smooth running engine with minimal exhaust emissions.

Figure 7:
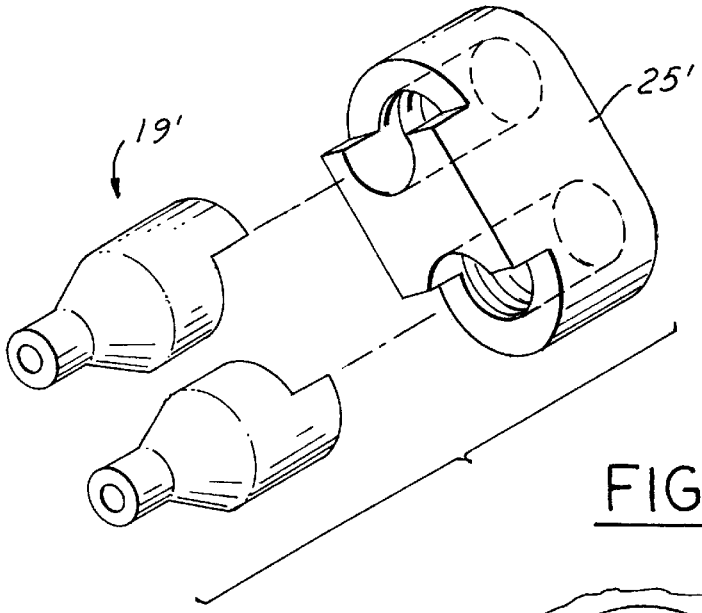
FIG. 7 is a perspective exploded view of a second embodiment of the low and high speed threadable holders of the present invention.
Figure 8:
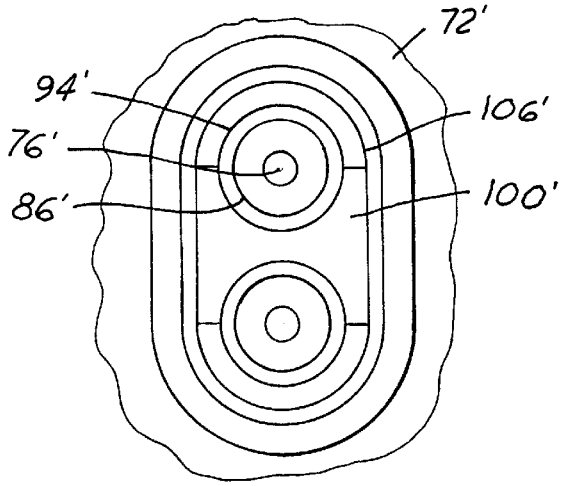
FIG. 8 is perspective view of the second embodiment of the carburetor body showing the receptacles which receive the threadable holders of FIG. 7.

Referring to FIGS. 7 and 8, a second embodiment of the present invention is shown wherein the threadable holder 25' of the low speed needle valve assembly 74' and the high speed needle valve assembly 75' are rigidly and unitarily connected. Because the threadable holders 25' are inherently incapable of rotating within their respective receptacles 78' the counter and counter clockwise rotational stop surfaces 102, 104 and the semi annular shelves 98, 100 of the carburetor body 72 of the first embodiment are no longer required. Essentially, a single planar surface 100' provides the inward axial stop when press fitting the compounded threading portion 25' into the compounded threaded chamber 96' defined by the wall 106'. Therefore, the boring and machining process of the carburetor body 72 is simplified. However, the sealing ability between the threading chamber wall 106' and the threadable holder 25' may be degraded due to the increase in sealing area which is not exposed to high compressive radial forces.

Figure 9:
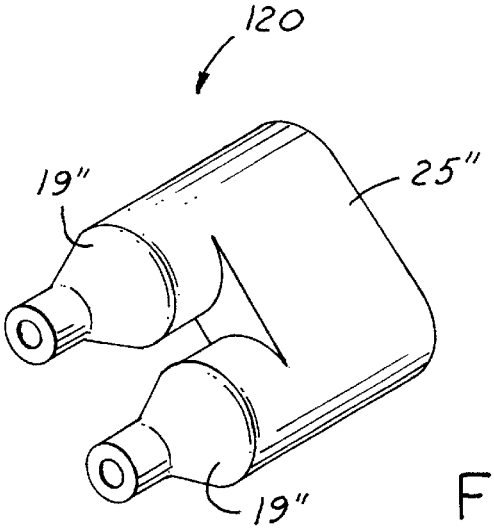
FIG. 9 is a third embodiment of the low and high speed sealing and threadable holders of the present invention.

FIG. 9 illustrates a third embodiment of a compound holder 120 in which the sealing holders 19' of the second embodiment are unitarily attached or molded to the threadable holder 25' of the second embodiment. This has the particular advantage of eliminating parts and reducing the cost of manufacturing and of assembly. However, the sealing holders 19" are now interrelated and any adverse effects within one receptacle may or can influence the sealing effects of the other receptacle.

While the forms of the invention herein disclosed constitute presently preferred embodiments many others are possible. It is not intended herein to mention all the possible equivalent forms or ramifications of the invention. It is understood that the terms used herein are merely descriptive, rather than limiting, and that various changes may be made without departing from the spirit or scope of the invention.

We claim:

1. A carburetor fuel mixture adjustment assembly for adjusting the fuel-air ratio of a fuel mixture to be supplied to an internal combustion engine, the assembly comprising:

a carburetor body having a clockwise rotational stop surface, a counterclockwise rotational stop surface, a needle valve receptacle and a fuel passage, the receptacle intersecting the fuel passage, the receptacle having a centerline, the clockwise rotational stop surface and the counterclockwise rotational stop surface exposed within the receptacle and extending both axially and radially with respect to the centerline;

a needle valve body disposed rotateably within the needle valve receptacle, the needle valve body having a needle portion and an exteriorly threading portion, the needle portion being axially advanceable into the fuel passage and retractable out of the fuel passage by rotation of the needle valve body to respectively decrease and increase fuel flow through the fuel passage; and an elongated threadable holder constructed and arranged to engage rigidly to the carburetor body within the receptacle, the threadable holder having a bore, thread grooves exposed within the bore, a clockwise facing surface and a counterclockwise facing surface, the bore extended axially and centered about the centerline, the clockwise facing surface engaged to the clockwise rotational stop surface of the carburetor body, the counterclockwise facing surface engaged to the counterclockwise rotational stop surface of the carburetor body, the needle valve body extended longitudinally through the bore of the threadable holder, the threadable holder made of a material softer than the needle valve body so that the needle valve body can be fitted rotateably into the threadable holder while the threading portion cuts the interior thread groove into the threadable holder.

2. The carburetor fuel mixture adjustment assembly as set forth in claim 1 further comprising:

the receptacle having a threading chamber; and the carburetor body having an inner shelf, and an outer shelf, the inner and outer shelves exposed within the threading chamber, facing axially outward, and disposed about and perpendicular to the centerline, the inner shelf disposed axially inward from the outer shelf, the inner shelf extended between and disposed perpendicular to the clockwise and counterclockwise rotational stop surfaces, the clockwise rotational stop surface extended between the inner and outer shelves, the outer shelf extended between and disposed perpendicular to the counterclockwise and clockwise rotational stop surfaces, the counterclockwise rotational stop surface extended between the outer and inner shelves.

3. The carburetor fuel mixture adjustment assembly as set forth in claim 2 wherein the threadable holder has a distal end surface and a recessed end surface encircling the bore, the distal end surface engaged to the inner shelf and the recessed end surface engaged to the outer shelf of the carburetor body.

4. The carburetor fuel mixture adjustment assembly as set forth in claim 3 wherein the carburetor body has a threading chamber wall encircling the centerline and extended axially outward from the inner and outer shelves, the threadable holder being press fitted radially against the threading chamber wall.

5. The carburetor fuel mixture adjustment assembly as set forth in claim 4 further comprising:

the needle valve body having a stem portion engaged to the needle portion and a shank portion engaged concentrically between the stem portion and the threading portion;

the receptacle having a fuel chamber and a sealing chamber aligned axially between the fuel chamber and the threading chamber, the fuel chamber intersecting the fuel passage, the shank portion of the needle valve body disposed within the sealing chamber, the stem portion aligned axially and adjustably within the fuel chamber and the sealing chamber;

the carburetor body having a sealing chamber wall encircling the centerline and extended axially outward to the inner and outer shelves; and a sealing holder disposed radially and sealingly between the shank portion of the needle valve body and the sealing chamber wall.

6. The carburetor fuel mixture adjustment assembly as set forth in claim 5 wherein the sealing holder is unitary to the threadable holder.

7. The carburetor fuel mixture adjustment assembly as set forth in claim 5 wherein the sealing holder has a shank holder portion and a stem holder portion, the shank holder portion engaged radially between the sealing chamber wall and the shank portion of the needle valve body, the stem holder portion engaged radially between a fuel chamber wall defining the fuel chamber and the stem portion of the needle valve body.

8. The carburetor fuel mixture adjustment assembly as set forth in claim 7 wherein the fuel chamber wall extends axially outward to a conical surface exposed within the sealing chamber, the conical surface extending radially and axially outward to the sealing chamber wall, the sealing chamber wall extended axially outward to the inner and outer shelves, the stem holder portion of the sealing holder engaged radially between the stem portion of the needle valve body and the fuel chamber wall, the shank holder portion of the sealing holder engaged radially between the shank portion of the needle valve body and the sealing chamber wall.

9. The carburetor fuel mixture adjustment assembly as set forth in claim 8 wherein the sealing holder has a distal outer end surface, a recessed outer end surface, a first rotational stop and a second rotational stop, the first rotational stop engaged to the counterclockwise facing surface of the threadable holder, the second rotational stop engaged to the clockwise facing surface of the threadable holder, the distal outer end surface engaged to the recessed inner end surface of the threadable holder, and the recessed outer end surface engaged to the distal inner end surface of the threadable holder.

10. The carburetor fuel mixture adjustment assembly as set forth in claim 9 wherein the sealing chamber and the threading chamber of the receptacle are cylindrical.

11. The carburetor fuel mixture adjustment assembly as set forth in claim 10 wherein the clockwise and counterclockwise facing surfaces of the threadable holder, the clockwise and counterclockwise rotational stop surfaces of the carburetor body, and the first and second rotational stops of the sealing holder lie within the same imaginary plane.

12. A carburetor fuel mixture adjustment assembly for adjusting the fuel-air ratio of a fuel mixture to be supplied to an internal combustion engine, the assembly comprising:

a carburetor body having a fuel chamber wall, a needle valve receptacle and a fuel passage, the receptacle having a centerline, a fuel chamber intersecting the fuel passage, and a sealing chamber, the fuel chamber defined axially by the fuel chamber wall and having an outlet orifice and an inlet orifice, the outlet orifice communicating axially inward to the fuel chamber and centered about the centerline, the inlet orifice communicating traversely to the centerline and through the fuel chamber wall, the sealing chamber communicating with and disposed axially outward from the fuel chamber, the sealing chamber defined axially by the sealing chamber wall disposed radially outward with respect to the fuel chamber wall;

a needle valve body disposed rotateably within the needle valve receptacle, the needle valve body having a needle portion, a stem portion, and a shank portion, the stem portion engaged longitudinally between the needle portion and the shank portion, the stem portion having a diameter less than the shank portion diameter, the needle portion projected concentrically into the outlet orifice from the stem portion, the stem portion projected into the fuel chamber from the shank portion, the shank portion disposed within the sealing chamber, the needle portion being axially advanceable into the outlet orifice and retractable out of the outlet orifice by rotation of the needle valve body to respectively decrease and increase fuel flow through the fuel passage; and a stepped sealing holder having a stem holder portion and a shank holder portion, the stem holder portion engaged to and disposed axially inward from the shank holder portion, the stem holder portion disposed radially and engaged concentrically between the stem portion of the needle valve body and the fuel chamber wall, and the shank holder portion disposed radially and sealingly between the shank portion of the needle valve body and the sealing chamber wall.

13. The carburetor fuel mixture adjustment assembly as set forth in claim 12 further comprising:

the needle valve body having a threading portion engaged concentrically to and axially outward from the shank portion; and an elongated threadable holder constructed and arranged to engage rigidly to the carburetor body within the receptacle, the threadable holder having a bore, thread grooves exposed within the bore, the needle valve body extended longitudinally through the bore of the threadable holder, the threadable holder made of a material softer than the needle valve body so that the needle valve body can be fitted rotateably into the threadable holder while the threading portion cuts the interior thread groove into the threadable holder.

14. The carburetor fuel mixture adjustment assembly as set forth in claim 13 further comprising:

the carburetor body having a clockwise rotational stop surface and a counterclockwise rotational stop surface both exposed within the threading chamber of the receptacle and extending both axially and radially with respect to the centerline;

the threadable holder having a clockwise facing surface and a counterclockwise facing surface, the clockwise facing surface engaged to the clockwise rotational stop surface of the carburetor body, the counterclockwise facing surface engaged to the counterclockwise rotational stop surface of the carburetor body; and the shank holder portion of the sealing holder having a first rotational stop and a second rotational stop, the first rotational stop disposed radially inward from and coplanar to the counterclockwise rotational stop surface of the carburetor body, the second rotational stop disposed radially inward from and coplanar to the clockwise rotational stop surface of the carburetor body, the first rotational stop engaged to the counterclockwise facing surface of the threadable holder, and the second rotational stop engaged to the clockwise facing surface of the threadable holder.

* * * * *

UNITED STATES PATENT AND TRADEMARK OFFICE

CERTIFICATE OF CORRECTION

PATENT NO. : 6,491,288 B2
DATED : December 10, 2002
INVENTOR(S) : Noriyuu Nagata et al.

It is certified that error appears in the above-identified patent and that said Letters Patent is hereby corrected as shown below:

Column 9,
Line 16, delete “traversely” and insert -- transversely --.

Signed and Sealed this

Sixteenth Day of September, 2003

JAMES E. ROGAN
*Director of the United States Patent and Trademark Office*